US010769927B2

(12) United States Patent
Bauldree et al.

(10) Patent No.: US 10,769,927 B2
(45) Date of Patent: Sep. 8, 2020

(54) FIRST RESPONSE LOCATOR SYSTEM

(71) Applicants: Kenneth Bauldree, Doylestown, PA (US); Angela Glynn, Ft. Meyers, FL (US)

(72) Inventors: Kenneth Bauldree, Doylestown, PA (US); Angela Glynn, Ft. Meyers, FL (US)

(73) Assignee: First Response Locator Systems of America, LLC, Macon, GA (US)

( * ) Notice: Subject to any disclaimer, the term of this patent is extended or adjusted under 35 U.S.C. 154(b) by 0 days.

(21) Appl. No.: 16/695,326

(22) Filed: Nov. 26, 2019

(65) Prior Publication Data

US 2020/0098236 A1 Mar. 26, 2020

Related U.S. Application Data

(63) Continuation-in-part of application No. 15/235,493, filed on Aug. 12, 2016, now Pat. No. 10,497,229.

(60) Provisional application No. 62/205,477, filed on Aug. 14, 2015.

(51) Int. Cl.

| | |
|---|---|
| ***G08B 21/10*** | (2006.01) |
| ***G08B 21/02*** | (2006.01) |
| ***G08B 3/10*** | (2006.01) |
| ***G08B 5/00*** | (2006.01) |
| ***G08B 5/36*** | (2006.01) |

(52) U.S. Cl.

CPC ..... *G08B 21/10* (2013.01); *G08B 3/1016* (2013.01); *G08B 5/002* (2013.01); *G08B 5/36* (2013.01); *G08B 21/028* (2013.01)

(58) Field of Classification Search

CPC ..... G08B 21/028; G08B 21/10; G08B 5/002; G08B 5/36; G08B 3/1016

See application file for complete search history.

(56) References Cited

U.S. PATENT DOCUMENTS

| | | | |
|---|---|---|---|
| 5,155,470 | A | 10/1992 | Tuttle |
| 7,068,760 | B2 | 6/2006 | Binning |
| 8,207,821 | B2 | 6/2012 | Roberge et al. |
| 9,349,262 | B2 | 5/2016 | Henrie |
| 9,619,125 | B2 | 4/2017 | Ruszala |
| 9,928,702 | B2 | 3/2018 | Bauldree et al. |
| 2002/0109985 | A1 | 8/2002 | Voacolo |
| 2005/0128748 | A1 | 6/2005 | Suwa |
| 2005/0134455 | A1 | 6/2005 | Binning |
| 2005/0143048 | A1 | 6/2005 | Binning |
| 2007/0241922 | A1 | 10/2007 | Brannon |
| 2009/0309723 | A1 | 12/2009 | Freebody et al. |
| 2012/0195035 | A1 | 8/2012 | Rodriguez et al. |

(Continued)

*Primary Examiner* — Orlando Bousono

(74) *Attorney, Agent, or Firm* — Jason T. Daniel, Esq.; Daniel Law Offices, P.A.

(57) ABSTRACT

A first response locator system includes a portable emergency locator device having functionality for being carried by an individual and being positioned within a housing. The locator device including a plurality of lighting elements that generate light in a plurality of different colors. The device includes a speaker for generating an audible sound. The lighting elements and speaker are controlled by an internal controller having a communication unit that receives operating instructions from a remote operation device. The housing is adapted for use with an existing mailbox or other outdoor structure and includes mounting hardware for securement thereto.

16 Claims, 11 Drawing Sheets

(56) References Cited

U.S. PATENT DOCUMENTS

| | | | | |
|---|---|---|---|---|
| 2013/0307685 | A1 | 11/2013 | Sholder | |
| 2015/0048951 | A1 | 2/2015 | Chesney | |
| 2015/0181677 | A1 | 6/2015 | Martinez | |
| 2015/0228176 | A1 | 8/2015 | Sholder | |
| 2016/0063824 | A1 | 3/2016 | Fiore | |
| 2016/0078752 | A1* | 3/2016 | Vardi | G08B 29/046 340/506 |
| 2016/0284170 | A1 | 9/2016 | Kasmir et al. | |
| 2017/0046926 | A1 | 2/2017 | Bauldree et al. | |
| 2018/0151034 | A1 | 5/2018 | Eddins et al. | |
| 2018/0249133 | A1* | 8/2018 | Thiel | H04N 7/185 |

* cited by examiner

FIRST RESPONSE LOCATOR SYSTEM

CROSS-REFERENCE TO RELATED APPLICATIONS

This application is a continuation-in-part to, and claims the benefit of U.S. Application Ser. No. 62/205,477 filed on Aug. 14, 2015 and Ser. No. 15/235,493 filed on Aug. 12, 2016, the contents of each of which are incorporated herein by reference.

TECHNICAL FIELD

The present invention relates generally to life safety devices, and more particularly to a first response locator device and system that can be selectively activated in an emergency situation.

BACKGROUND

The statements in this section merely provide background information related to the present disclosure and may not constitute prior art.

When emergencies happen it is important that a first responder be able to quickly find the individual(s) in distress. Whether the emergency requires the assistance of the police, paramedic/EMS, or the fire department, seconds can sometimes mean the difference between life and death.

In recent years, the implementation of GPS navigation systems within first responder vehicles has drastically shortened response times. Although these systems are extremely useful for finding a street or high-rise structure on which an emergency is located, first responders often spend several minutes attempting to locate the correct home or apartment unit. Additionally, when the emergency occurs in remote areas such as forest or desert locations, for example, it can be extremely difficult for first responders to find those in distress.

Within the United States, virtually every home, apartment, condo, and/or business location has a mailbox that is used for sending and receiving mail through the U.S. Postal Service. For detached homes, the mailbox typically includes a freestanding pedestal unit that is located adjacent to the street. Conversely, multi-dwelling units often utilize wall mounted units that are secured to an exterior wall of the building at a location adjacent to the apartment door. In either instance, such mailboxes often display the home or unit number to which it belongs, and it is this address which first responders look for in identifying they have arrived at the correct location.

Accordingly, it would be beneficial to provide a first response locator system that can be positionable within or along such structures, and that can be selectively removed so as to function as a personal location system when the user is traveling, so as to provide a conspicuous visual indication to guide first responders to the location of an emergency.

SUMMARY OF THE INVENTION

The present invention is directed to a first response locator system. One embodiment of the present invention can include a portable emergency locator device which can be carried by an individual via a connector, and that can be removably positioned within a housing at a conspicuous outdoor location such as a mailbox or a building wall. The locator device can include a plurality of lighting elements which can generate light in a plurality of different colors such as red, blue, and green, for example. The locator device can also include a speaker for generating an audible sound. The lighting elements and speaker can be controlled by an internal controller having a communication unit that is capable of receiving operating instructions from an external device.

Another embodiment of the present invention can include a remote operation device that can communicate with the internal controller to selectively activate one or both of the lighting elements and the speaker. The remote operation device can be constructed as a portable unit that is small enough to fit in the pocket of clothing or can be permanently affixed within a structure. The remote operation device can include a plurality of buttons which can be selectively activated to correspond to a fire, medical or police emergency.

In yet another embodiment of the present invention, the housing can be adapted for use with an existing mailbox or other outdoor structure and can include a mounting bracket for securement thereto.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
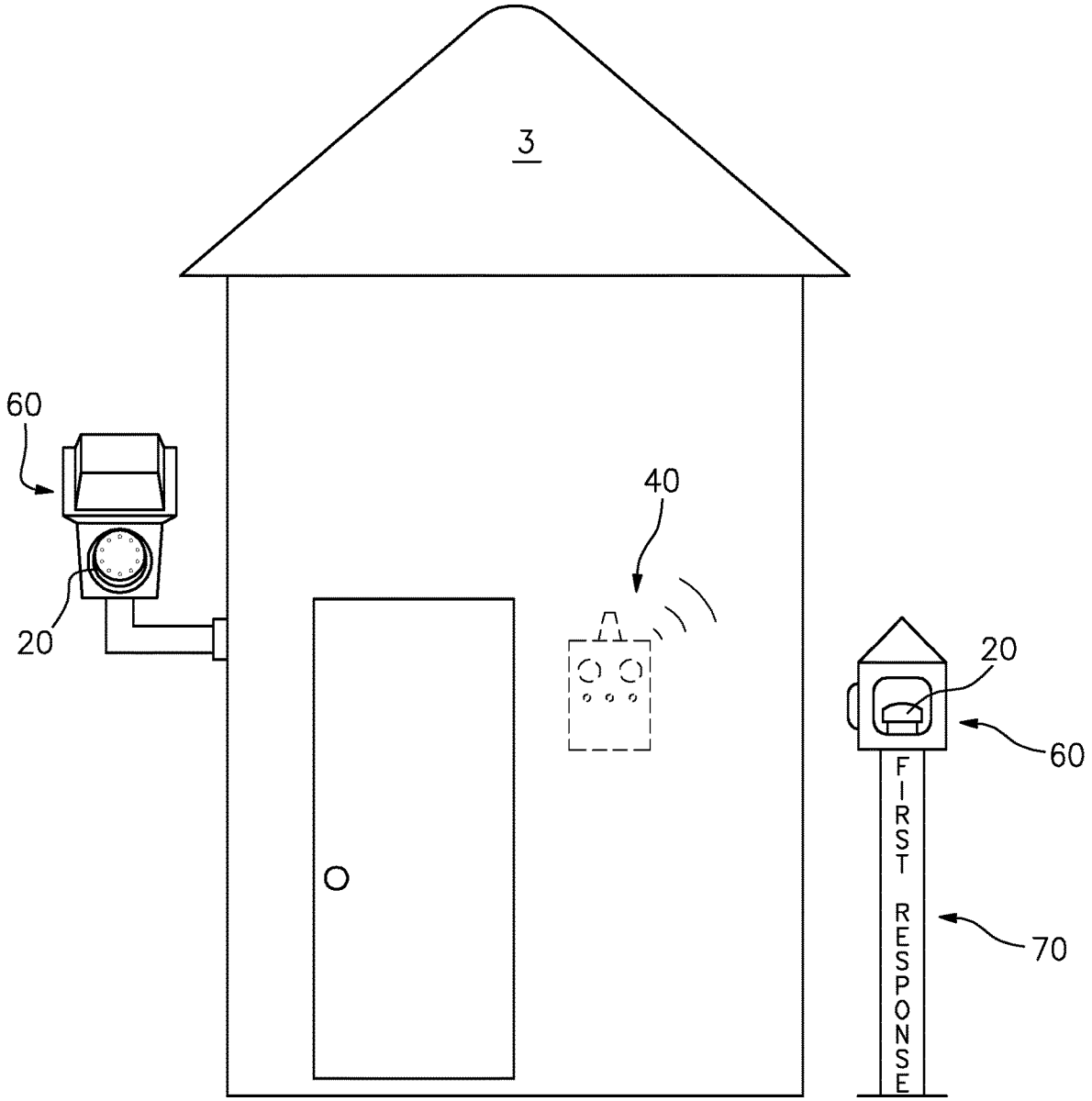
FIG. 1 is an exemplary operating environment of a first response locator system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions:

As described herein, the term "unit" and "device" are used interchangeably to refer to a series of identified physical components which are linked together and/or function together to perform the specified functionality.

As described herein, the terms "connector" and "complementary connector" include any number of different elements that work together to repeatedly join two items together in a non-permanent manner. Several nonlimiting examples include opposing strips of hook and loop material (i.e. Velcro®), attractively-oriented magnetic elements or magnetic and metallic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of the first response locator system for assisting first responders to locate a particular building 3, residence and/or individual. As shown, the system can include a one or both of a freestanding emergency locator housing 60, and a mounted emergency locator housing 70, each having a removable first response locator device/unit 20 that communicates with a remote operation device 50 positioned therein.

Figure 2A:
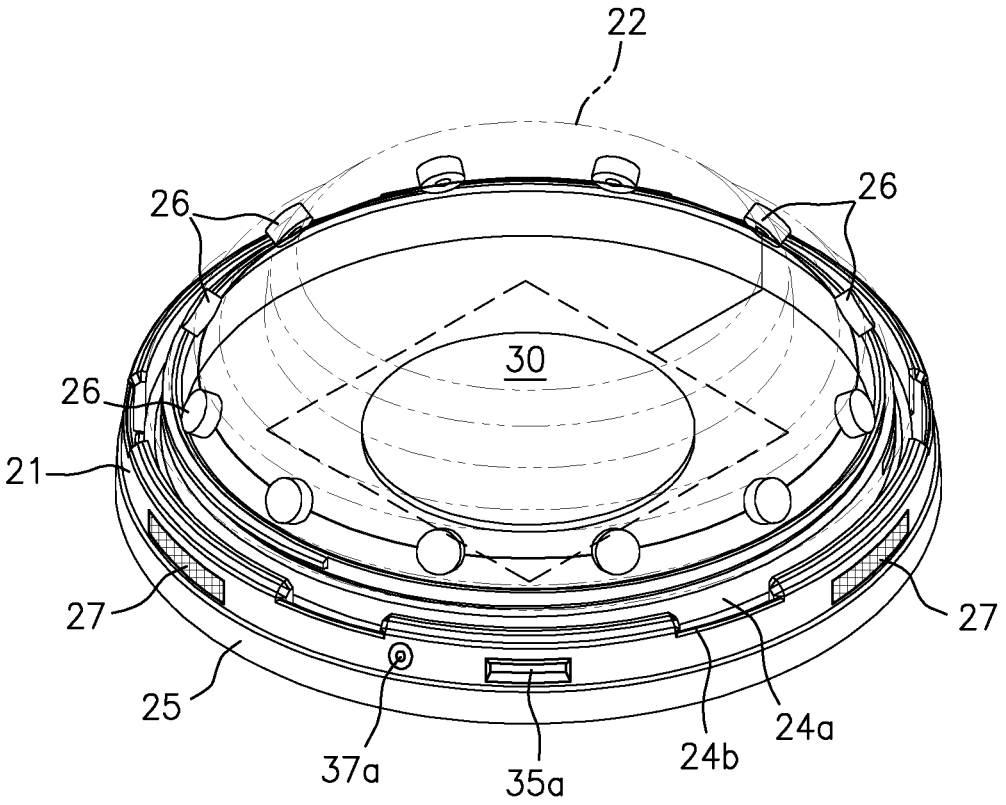
FIG. 2A is a perspective view of an emergency locator device, in accordance with one embodiment of the invention.
Figure 2B:
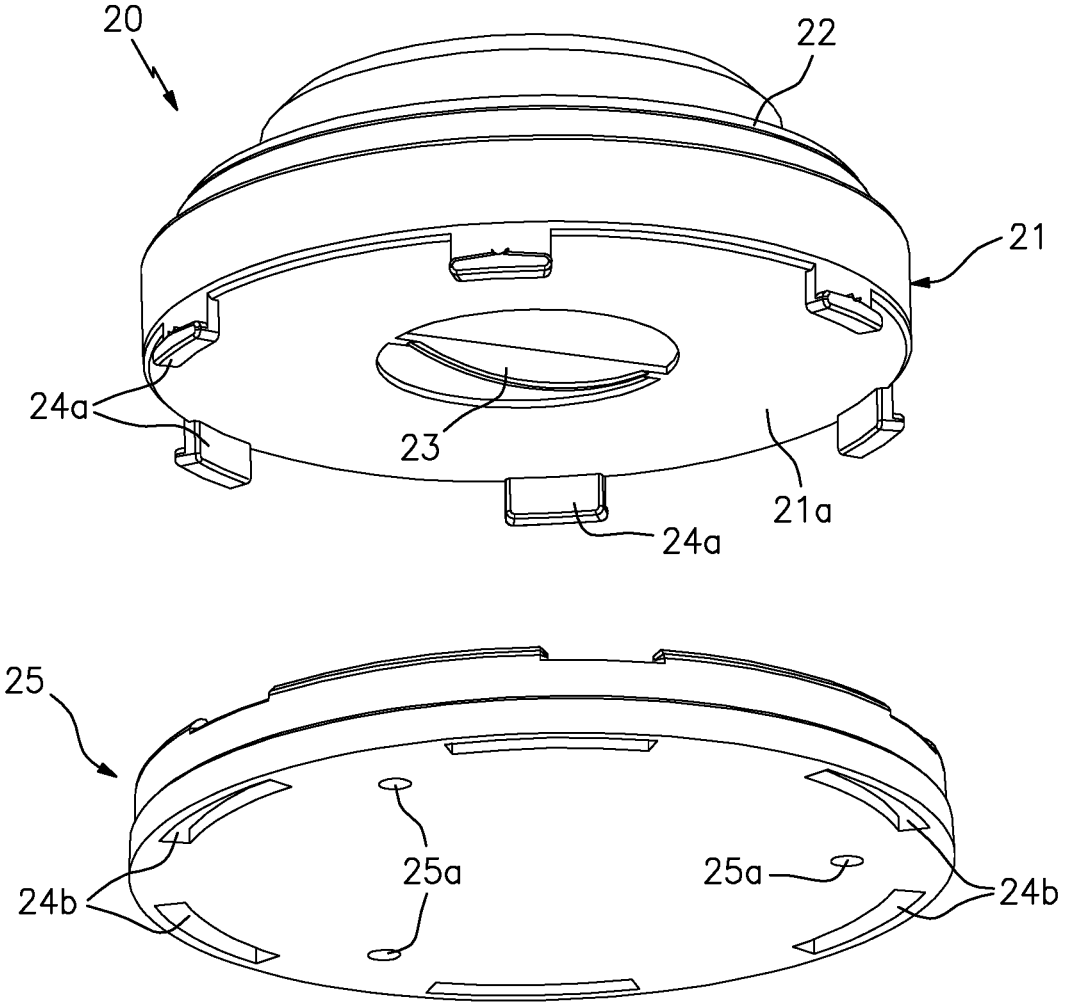
FIG. 2B is a perspective view of the emergency locator device and mounting plate, in accordance with one embodiment of the invention.

FIGS. 2A and 2B illustrate one embodiment of a first response locator unit 20. As shown, the unit can include a compact body that includes a bottom wall 21 and a translucent or generally transparent cover 22 that extends upward from the bottom wall to form an interior space for storing a plurality of system components.

In the preferred embodiment, the body and cover can include the illustrated circular shape so as to allow the below described lighting elements to shine in an unobstructed 360-degree field of view. Additionally, it is preferred that the body and cover be constructed from a lightweight and rugged material such as plastic, for example, that are joined together so as to form a watertight interior space. Of course, any number of other shapes and materials are also contemplated.

Figure 5:
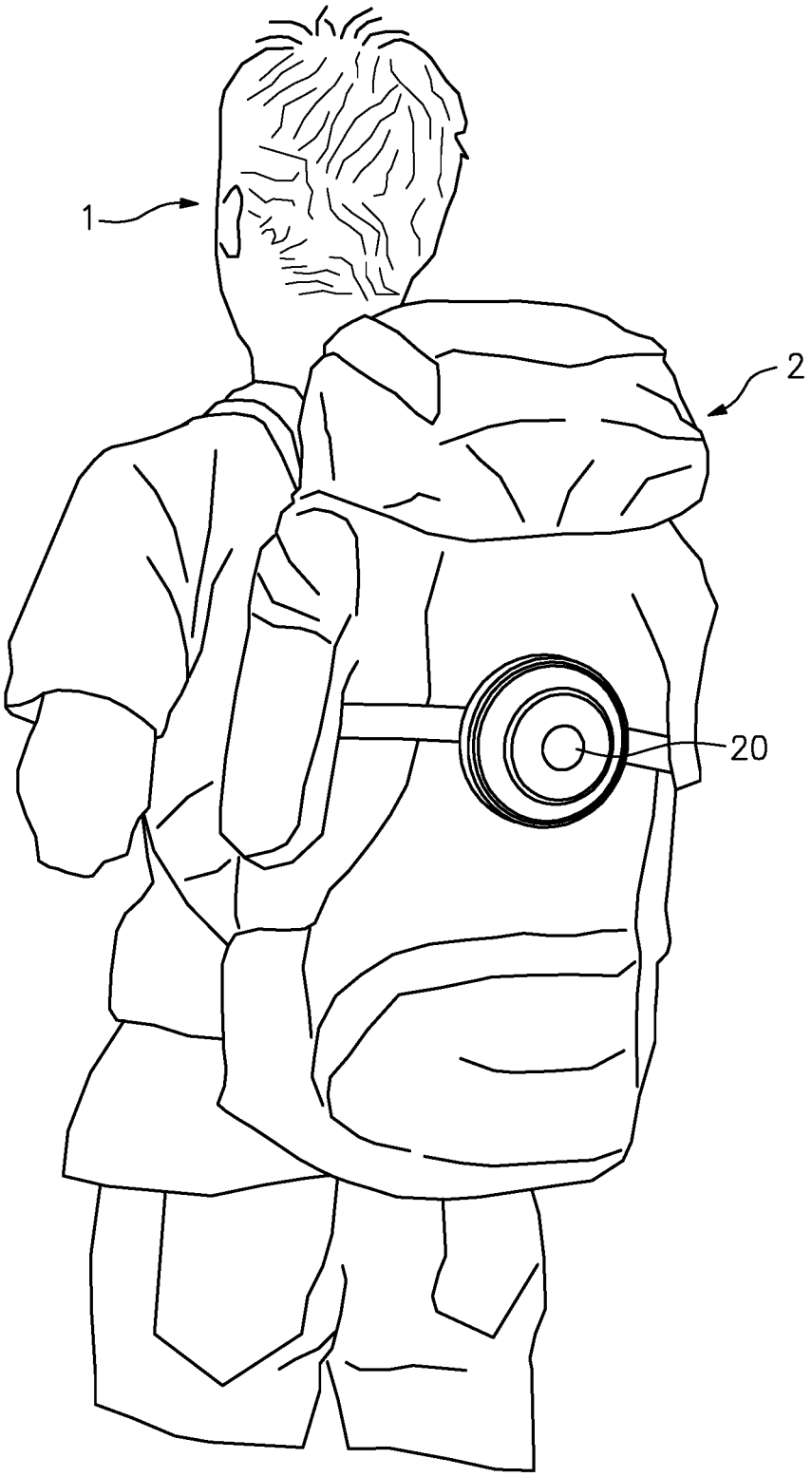
FIG. 5 is a perspective view of the emergency locator device in operation, in accordance with one embodiment of the invention.

In one embodiment, the bottom of the body can include a plurality of connectors such as a channel 23 for allowing the device to be secured to a belt or other such object when being carried by a user (See FIG. 5). In one embodiment, the connectors can include a plurality of angled protrusions 24*a* which can be removably engaged to a plurality of complementary shaped indentations 24*b* that can be located along a mounting plate 25.

As shown, the mounting plate 25 can include a complementary shape to the body 21 and can include any number of mounting apertures 25*a* for receiving hardware such as screws or bolts, for example, to permanently secure the mounting plate onto a secondary object such as the below described housing 60 and platform 70, for example, while allowing the device 20 to be removed therefrom.

In one embodiment, a plurality of lighting elements 26, such as light emitting diodes (LED), for example, can be positioned within the interior space of the main body. Of course, number and/or type of other light producing element(s) can be utilized herein such as various compact fluorescent, incandescent, and/or halogen lights, for example.

Each of the lighting elements 26 can be controlled by the internal controller 30 and can be selectively activated via an onboard switch 35*a* and/or the remote operation device 40. In the preferred embodiment, the lighting elements 26 will be configured to generate red, green and blue light. Of course, the lighting unit can function to generate continuous and/or bursts of light in any number of different colors, intensities and/or durations.

In various embodiments, one or more speakers 27 can also be provided along or within the device 20 body. Each of the speakers can function to play an audible sound such as an alarm tone and/or a pre-recorded message, for example, based on an instruction from the internal controller 40 and/or the remote operation device 50.

Figure 3:
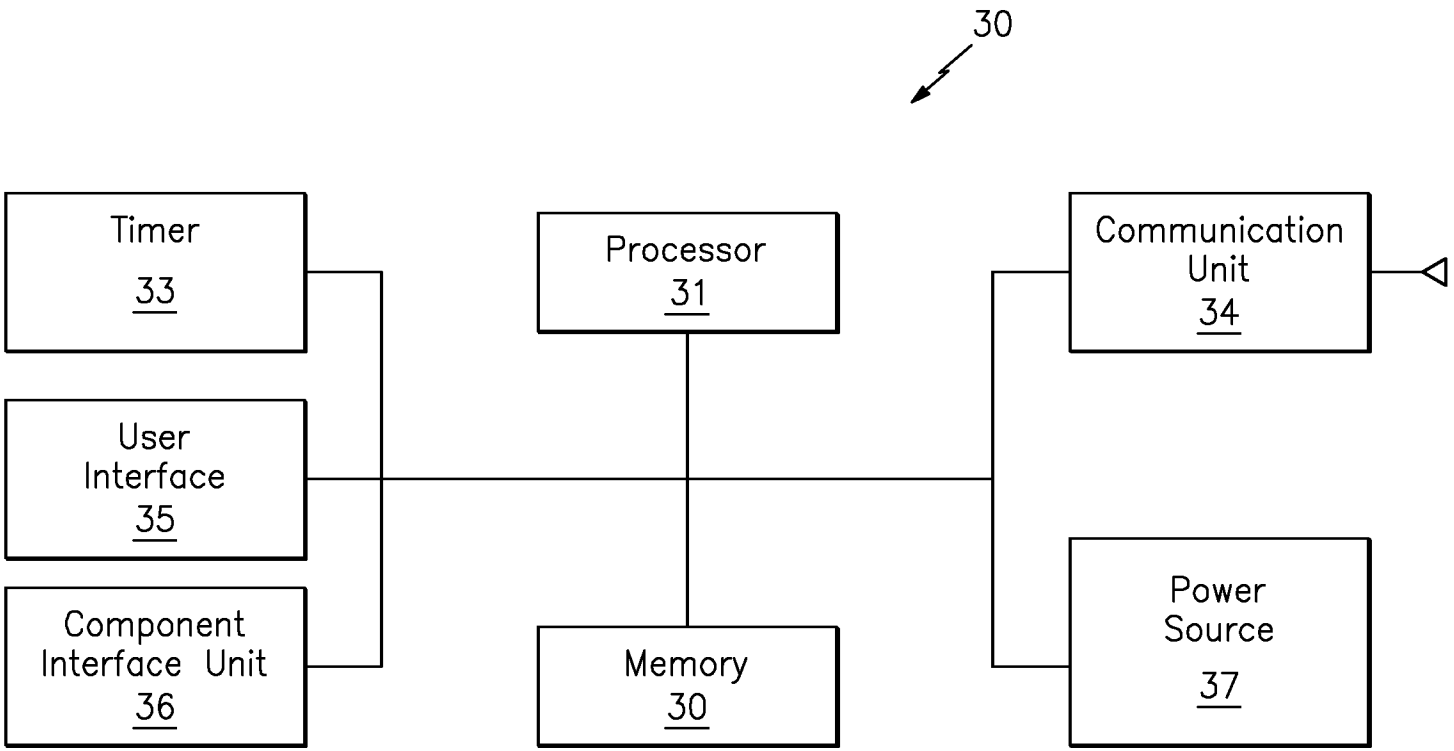
FIG. 3 is a simplified block diagram of the internal controller of the emergency locator device, in accordance with one embodiment of the invention.

FIG. 3 is an exemplary block diagram of an internal controller 40 which can be provided within the main body of the locator unit 20. As shown, the internal controller 30 can include, comprise or be connected to any number of components such as a processor 31 that is conventionally connected to an internal memory 32, a timer module 33, a communication unit 34, a user interface 35, a component interface unit 36, and/or a power source 37.

The processor/CPU 31 can act to execute program code stored in the memory 32 in order to allow the device to perform the functionality described herein. Likewise, a timer module 33 can be provided, and can function to accurately measure the passage of time. As described herein, the timer module can be provided as a function of the processor or can include a separate physical circuit. In either instance, processors and timers are extremely well known in the art, therefore no further description will be provided.

Memory 32 can act to store operating instructions in the form of program code for the processor 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. Additionally, memory 32 can also include one or more cache memories that provide temporary storage of at least some program code in order to reduce the number of times program code must be retrieved from the bulk storage device during execution. Each of these devices are well known in the art.

The communication unit 34 can function to provide wired or wireless communication between the internal controller 30 and an external device. For example, the communication unit 34 can include a variable radio wave transceiver which can send and receive information wirelessly with the below described remote operation device 40. Alternatively, or in addition thereto, the communication unit 34 can include a Bluetooth transceiver for communicating wirelessly with a portable user device such as a smartphone that is running a First Response Locator App, for example. Of course, any number of other known transmission and reception mechanisms and protocols can also be utilized herein. Several non-limiting examples include cellular telephone and/or data transceivers, and/or a network adapter functioning to communicate over a WAN, LAN or the internet via an internet service provider, for example.

The user interface 35 can function to accept user inputs for instructing device operation. As such, the user interface can include or control one or more buttons/switches 35*a* that are connected to the processor 31 so as to activate various programmatic functions, such as pairing the unit 20 with an external device and/or transitioning the device between an ON and OFF operating state, for example.

The component interface unit 36 can function to provide a communicative link between the processor 31 and various other device components such as the above described lighting elements 26 and/or speakers 27, for example. In this regard, the component interface unit can include any number of different components such as one or more PIC microcontrollers, internal bus, USB connections and other such hardware capable of providing a direct link between the various components. Of course, any other means for providing the two-way communication between the identified components can also be utilized herein.

The power source 37 can include any number of different components capable of providing the necessary power requirements to each element of the locator unit. In the preferred embodiment, the power source can include or comprise any number of different batteries which can be positioned within the main body. In various embodiments, the batteries can be rechargeable in nature and can include a connector 37*a* for engaging a power cord 66 from a building's A/C electrical power source and/or solar panels 65 when positioned within a first response locator housing 60 (See FIG. 6).

Figure 4A:
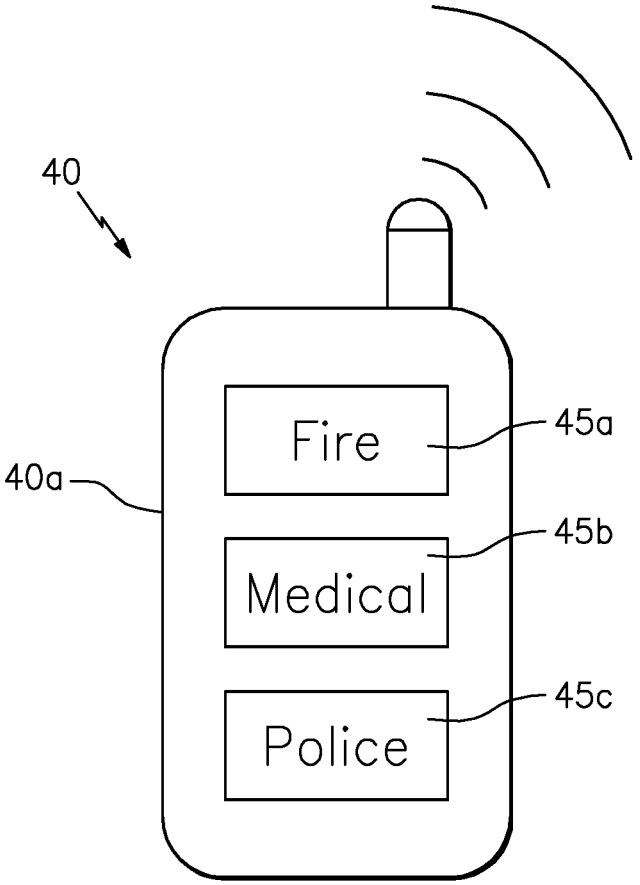
FIG. 4A is a perspective view of the remote operation device of the system, in accordance with one embodiment of the invention.
Figure 4B:
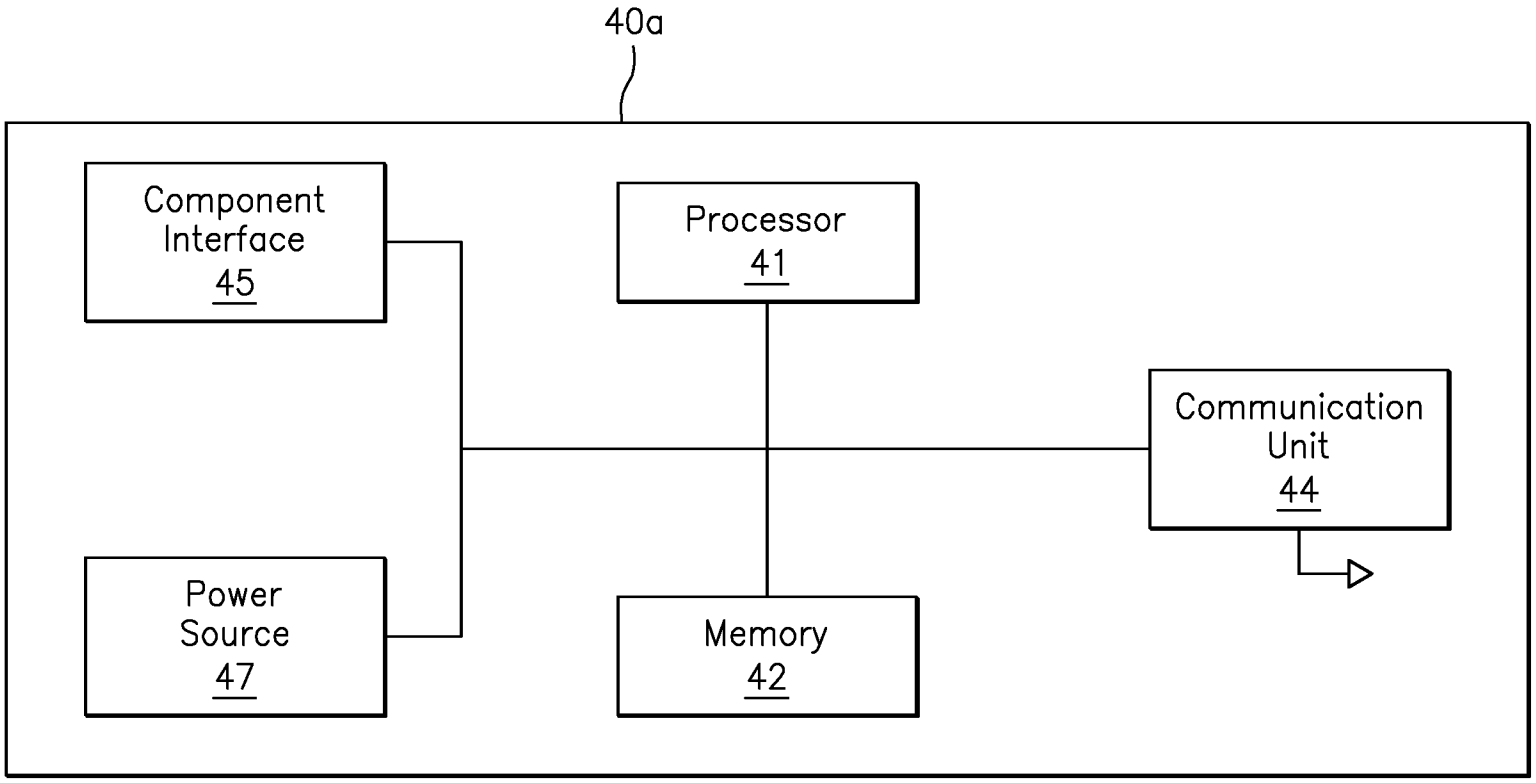
FIG. 4B is a simplified block diagram of the internal components of the remote operation device of the system, in accordance with one embodiment of the invention.

FIGS. 4A and 4B illustrate one embodiment of a remote operation device 40 which can function to selectively activate the locator unit 20. As shown, the device 40 can include a main body 40*a* which houses an internal processor 41, memory 42, communication unit 44, user interface 45 and power source 47. Each of the components 41, 42, 44, 45 and 47 being identical in form and function to those described above with respect to components 31, 32, 34, 35 and 37, respectively, therefore a duplicate description is not provided.

The main body 40*a* can include any number of different shapes and sizes and can be constructed from any number of different materials such as plastic, for example. The main body can be constructed so as to be portable in nature (e.g., pendant or keychain), or can be affixed to stationary location in a manner similar to an alarm control panel, for example.

In either instance, the device 40 can include a plurality of user interface components, such as the illustrated buttons, for example, that can be provided at any location along the main body 40*a*. Each of the buttons can function to selectively activate the lighting elements 26 and/or speaker 27 of the emergency locator unit to which the remote operation device is programed to communicate with.

In one non-limiting example, the remote operation device 40 can include a first button 45*a* which can be selectively engaged by a user to transmit a first signal to the internal controller 30 of an emergency locator unit 20. Upon receiving the first signal, the lighting elements 26 can immediately begin to flash red light, so as to assist firefighters in locating the building or residence at which a fire is occurring.

In another non-limiting example, the remote operation device 40 can include a second button 45*b* which can be selectively engaged by a user to transmit a second signal to the internal controller 30 of a particular locator unit 20. In the present example, receipt of this second signal can cause the lighting elements 26 to flash blue light, so as to assist EMS responders in locating the building or residence at which a medical emergency is occurring.

In yet another non-limiting example, the remote operation device 40 can include a third button 45*c* which can be selectively engaged by a user to transmit a third signal to the internal controller 30 of a particular locator unit 20. In the present example, receipt of this third signal can cause the speaker 27 to produce an alarm and can cause the lighting elements 26 to flash red and blue light, so as to assist police in locating the building or residence at which help is needed.

The lighting unit and/or speakers in the above described examples can be programmed to operate only for a predetermined period of time, such as 30 minutes, for example, utilizing the internal timer, or can continue to operate until the respective button has been pressed again, thereby deactivating the operation of the locator unit.

FIG. 5 illustrates one embodiment of the device 20 in operation when carried by a user 1 when hiking or performing other outdoor activities in remote areas. As shown, the main body 21 can be secured onto the straps of a backpack 2 or other such item via the above described channel connector 23. In the event that the user becomes lost and calls for help, he or she can activate the lighting elements 26 and/or speaker 27 to aid in rescuers finding them. Additionally, because the device can produce light in a variety of colors, the lighting elements can function as an emergency flashlight when needed.

Figure 6A:
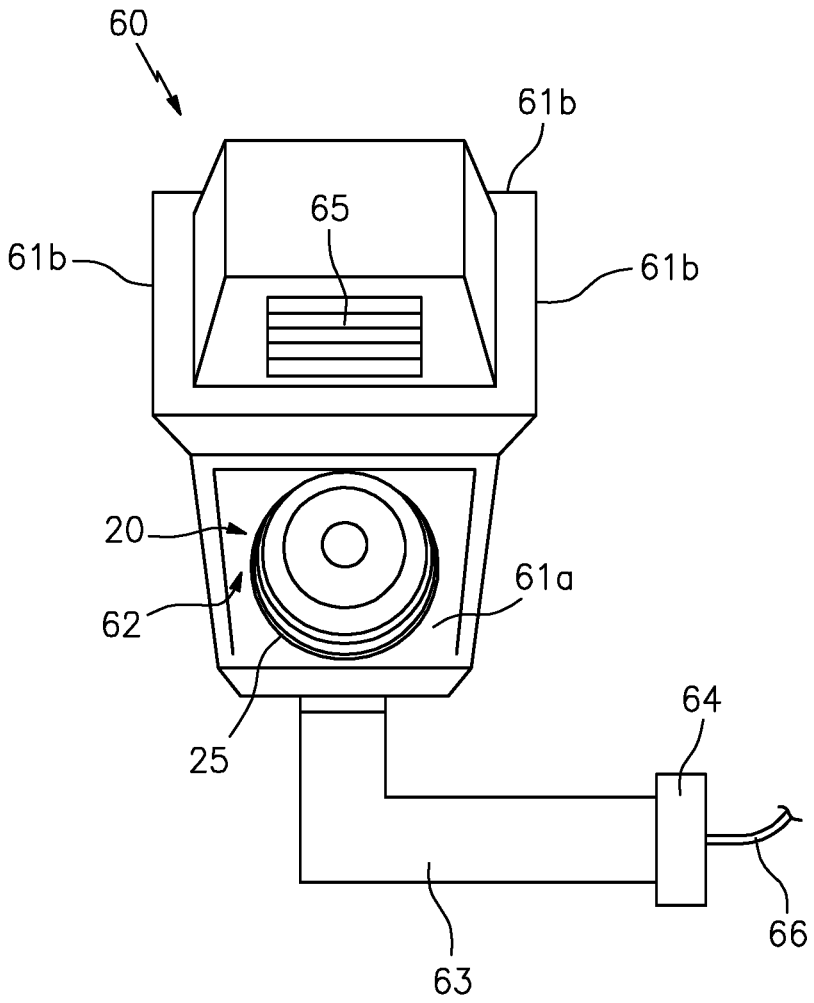
FIG. 6A is a perspective view of the emergency locator device and housing, in accordance with one embodiment of the invention.
Figure 6B:
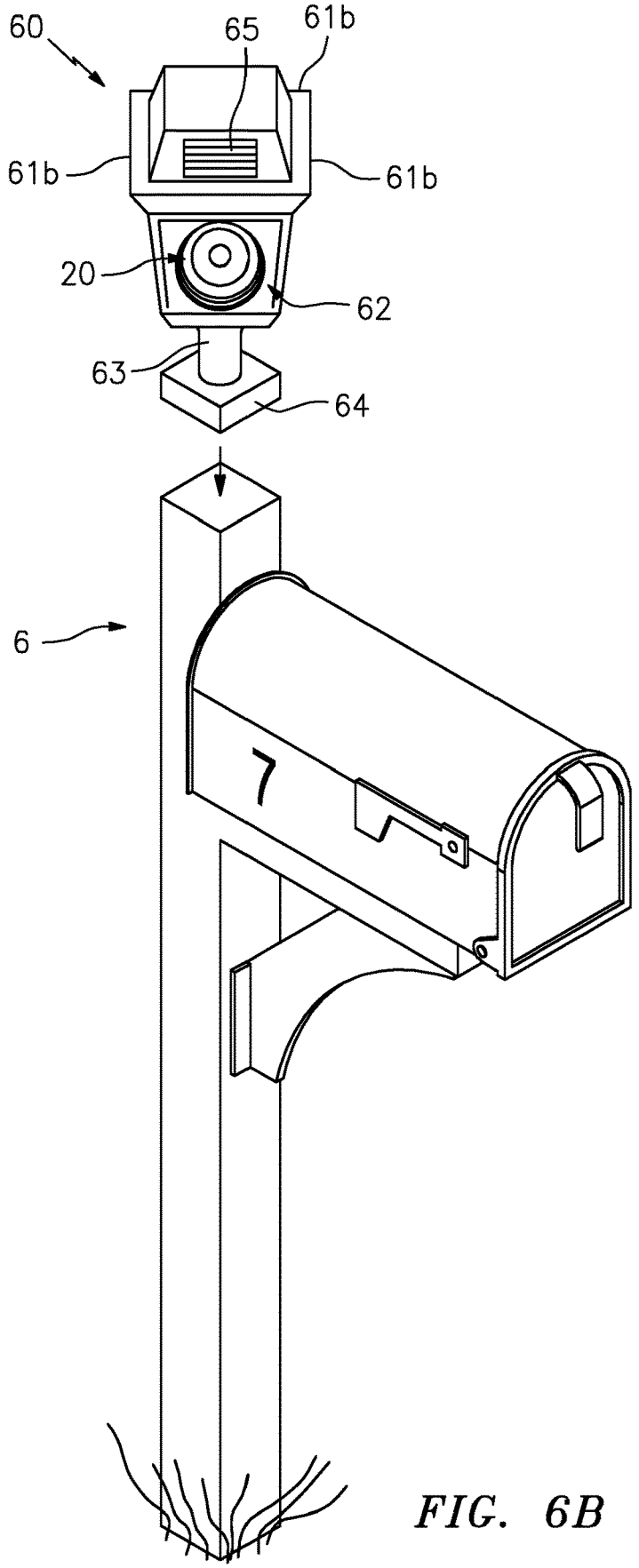
FIG. 6B is another perspective view of the emergency locator device and housing, in accordance with one embodiment of the invention.

FIGS. 6A and 6B illustrate one embodiment of a first response locator housing 60 which can be permanently or removably secured onto any number of secondary objects, and that can function to utilize the above described locator device 20 to identify a fixed location where assistance is needed.

In one embodiment, the housing 60 can include a main body having a bottom wall 61*a* onto which the mounting plate 25 of the first response locator device 20 can be secured. A plurality of upstanding walls 61*b* can extend from the bottom wall to form a hollow interior space for storing the portable locator unit 20. In this regard, the body of the housing can include any number of functional or decorative shapes and can include one wall that is removable so as to allow placement of the locator unit 20 within the interior space. Additionally, the housing can also include a plurality of clear or translucent panes 62 for allowing light generated by the portable locator unit 20 to shine therethrough in a 360-degree field of view. Of course, other embodiments are contemplated wherein the entire body is constructed from generally transparent materials in lieu of the panes.

In one embodiment, the housing 60 can include an elongated shaft 63 having hardware 64 such as a wall mount or post bracket, for example, that can function to secure the housing onto secondary objects such as a building wall or mailbox 6, for example.

In one embodiment, the housing 60 can include functionality for charging the onboard batteries of the locator device 20. As such, various embodiments can include one or more solar panels 65 and/or building power cable 66 that can be connected to the above described power connector 37*a* of the device 20. As such, power generated from the panels 65 or received from the buildings A/C power network can function to maintain a constant charge on the device batteries.

Figure 7A:
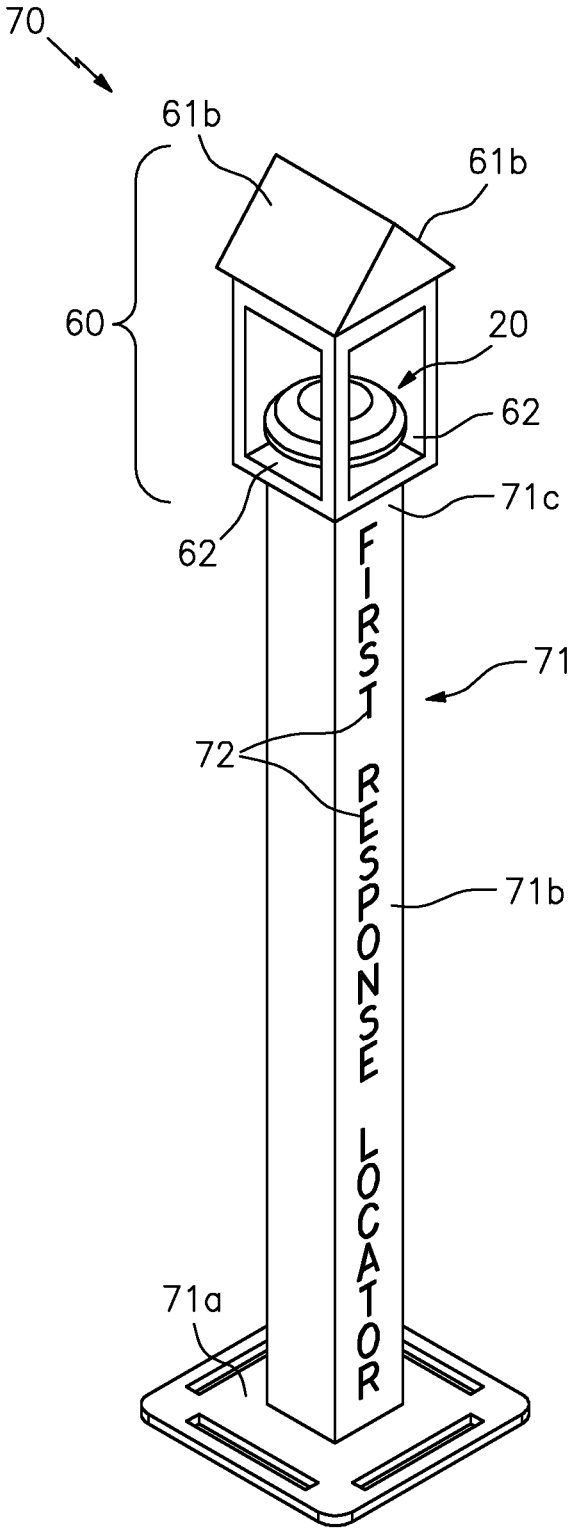
FIG. 7A is a perspective view of the emergency locator device, housing and platform, in accordance with one embodiment of the invention.
Figure 7B:
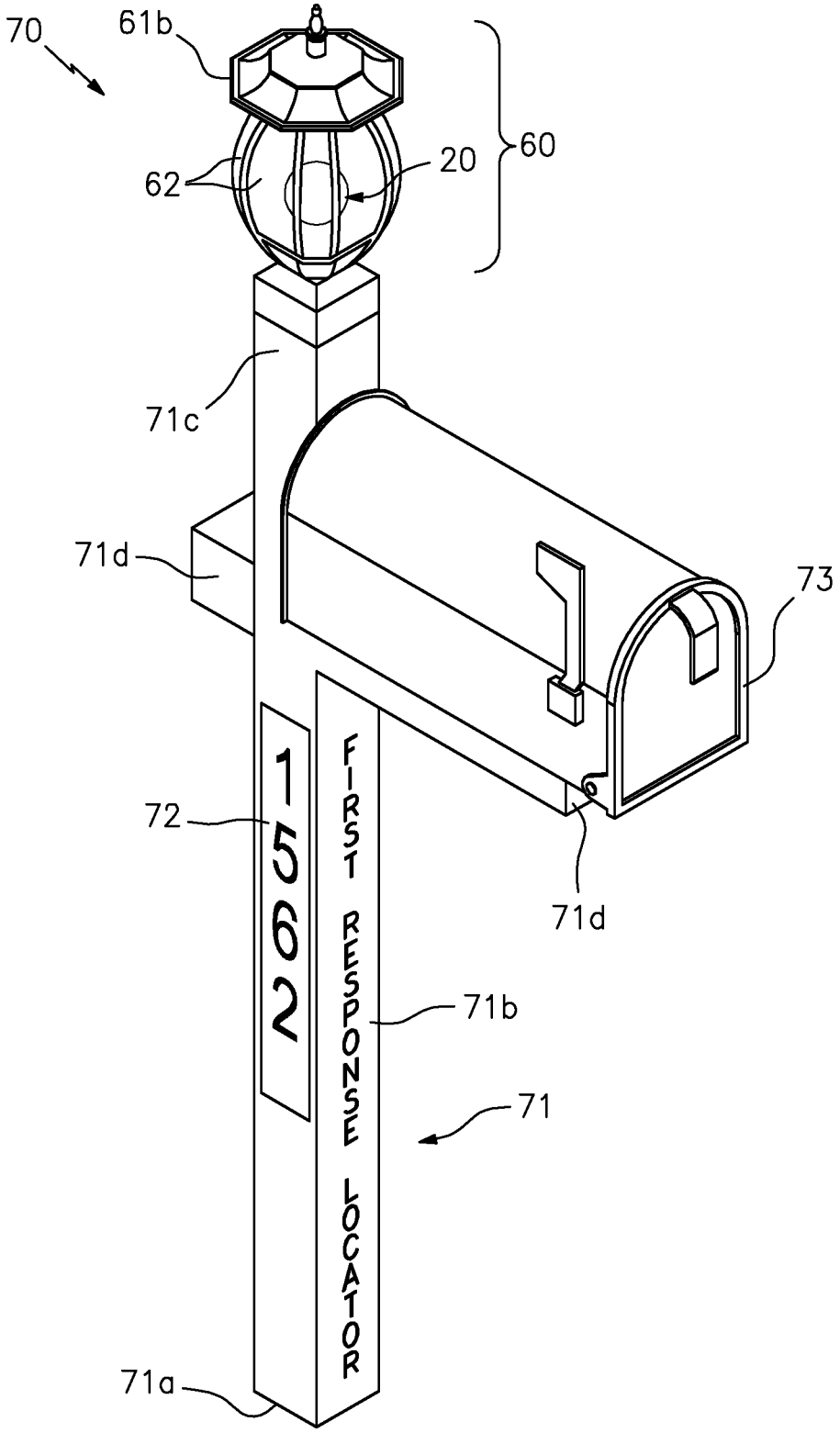
FIG. 7B is another perspective view of the emergency locator device, housing and platform, in accordance with one embodiment of the invention.

As shown at FIGS. 7A and 7B various embodiments can also include a dedicated freestanding platform 70 onto which the housing 60 can be positioned.

In one embodiment, the platform 70 can include an elongated main body 71 having a bottom end 71*a* for engaging the ground, a middle section 71*b* and a top end 71*c*. The main body can include any number of different shapes and sizes and can be constructed from any number of different materials that are suitable for prolonged use in an outdoor environment (i.e., weather resistant), such as various metals, plastics and/or composites, for example.

In the preferred embodiment, indicia 72 such as the building address, and/or emergency identification information, for example can be positioned along the main body. As described herein, the term "indicia" can also include any type of decorative and/or functional elements such as various colors, markings, words, shapes, symbols, logos, designs, lights, types of materials, texturing of materials, patterns, images, lithographs, and/or photographs, for example. The indicia can be secured onto and/or into the main body in accordance with known techniques so as to be flush with the surface of the main body or can be raised/protruding outward from the main body so as to give a three-dimensional effect.

As shown best at FIG. 7B, the platform 70 can also include a generally horizontal arm 71*d* onto which a mailbox 73 can be secured. In various embodiments, the horizontal arm can be positioned so as to ensure the height of the mailbox 73 from the ground is in compliance with any applicable laws and/or ordinances. Such a feature is particularly advantageous for new construction projects wherein the lifesaving benefits of the first response locator system can be seamlessly incorporated into the design of a new mailbox and can be deployed uniformly across an entire subdivision.

The platform 70 can be constructed so as to receive the housing 60 via the hardware 64 described above or can be constructed wherein the housing forms an integral component of the platform.

Accordingly, the above described first response locator system can function to provide an immediate visual indication of the location of an emergency, which can be viewed from great distances by a first responder. The locator device can be stored within a housing and/or platform for long term continuous use at a building or other location. When desired by a user, the device 20 can be removed from the platform and used to provide the emergency locator functionality for a user wherever they go.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A first response locator device, comprising:

a compact main body having a bottom wall and a transparent cover that form an interior space;

a mounting plate that is removably secured to the bottom wall by a first connector;

a plurality of lighting elements that are positioned within the main body;

an internal controller that is in communication with the plurality of lighting elements, said internal controller including a communication unit for communicating with an external device; and a remote operation device that includes a remote communication unit for communicating with the internal controller, said remote communication unit being configured to transmit a signal to the internal controller that selectively activates the lighting elements, wherein the remote operation device includes a portable main body, and a plurality of user input members that are configured to receive a user instruction, and wherein the plurality of user input members includes at least one button that is configured to selectively operate the plurality of lighting elements to produce at least one of a red light and a blue light for a predetermined period of time.

2. The device of claim 1, further comprising:

a secondary connector that is positioned along the bottom wall, said secondary connector being positioned between the bottom wall and the mounting plate.

3. The device of claim 2, wherein the first and secondary connectors comprise disparate components, and are not interoperable, wherein the first connector includes functionality for permanently securing the mounting plate onto a secondary object, and wherein the secondary connector includes functionality for removably securing the main body to a secondary object.

4. The device of claim 1 wherein the plurality of user input members includes another button that is configured to selectively operate the plurality of lighting elements to produce alternating beams of the blue light and the red light for a predetermined period of time.

5. The device of claim 1, further comprising:

a speaker that is disposed along the main body, said speaker being in communication with the internal controller and being selectively activated by the remote operation device.

6. The device of claim 5, wherein each of the plurality of user input members functions to selectively operate one or both of the speaker and the lighting elements.

7. The device of claim 1, wherein each of the plurality of lighting elements comprise light emitting diodes that are each configured to simultaneously generate light at a plurality of different colors.

8. The device of claim 1, further comprising:

a housing having a bottom wall, a plurality of upstanding walls and an interior space;

said interior space including a shape and size that is complementary to the shape and size of the compact main body, and being configured to permanently receive the mounting plate.

9. The device of claim 8, wherein the mounting plate is permanently secured within the interior space of the housing, and the main body is removably positioned within the interior space of the housing.

10. The device of claim 8, further comprising:

a plurality of transparent panes that are positioned within the upstanding walls.

11. The device of claim 8, further comprising:

an elongated arm having a first end that is in communication with the housing, and a second end having mounting hardware.

12. The device of claim 8, further comprising:

at least one solar panel that is disposed along the lighting unit.

13. A first response locator device, comprising:

a compact main body having a bottom wall and a transparent cover that form an interior space;

a mounting plate that is removably secured to the bottom wall by a first connector;

a plurality of lighting elements that are positioned within the main body;

an internal controller that is in communication with the plurality of lighting elements, said internal controller including a communication unit for communicating with an external device; and a remote operation device that includes a remote communication unit for communicating with the internal controller, said remote communication unit being configured to transmit a signal to the internal controller that selectively activates the lighting elements, wherein the remote operation device includes a portable main body, and a plurality of user input members that are configured to receive a user instruction, and wherein the plurality of user input members includes a plurality of buttons that are configured to selectively operate the plurality of lighting elements to emit light in a predefined and distinct color for a predetermined period of time.

14. The device of claim 13 wherein the plurality of user input members includes another button that is configured to selectively operate the plurality of lighting elements to produce alternating beams of light in two predefined and distinct colors for a predetermined period of time.

15. The device of claim 13, further comprising:

a speaker that is disposed along the main body, said speaker being in communication with the internal controller and being selectively activated by the remote operation device.

16. The device of claim 15, wherein each of the plurality of user input members functions to selectively operate one or both of the speaker and the lighting elements.

* * * * *